United States Patent [19]

Phillips

[11] 4,337,546

[45] Jul. 6, 1982

[54] FLOOR POLISHER SUPPORT

[75] Inventor: Paul E. Phillips, Whitehall, Mich.

[73] Assignee: McGraw-Edison Company, Rolling Meadows, Ill.

[21] Appl. No.: 144,192

[22] Filed: Apr. 25, 1980

[51] Int. Cl.[3] ..... A47L 11/162; A47L 11/40

[52] U.S. Cl. ..... 15/49 R; 15/246

[58] Field of Search ..... 15/49 R, 50 R, 50 C, 15/98, 385, 246, 49 C, 49 RB

[56] References Cited

U.S. PATENT DOCUMENTS

| | | | |
|---|---|---|---|
| 889,309 | 2/1908 | Jenkins . | |
| 1,079,298 | 11/1913 | Jenkins . | |
| 1,299,989 | 4/1919 | Miller . | |
| 1,591,682 | 7/1926 | Ponselle . | |
| 1,891,175 | 12/1932 | Petersen | 15/49 R X |
| 2,624,896 | 1/1953 | Atkin . | |
| 2,626,412 | 1/1953 | Petersen . | |
| 2,640,211 | 6/1953 | Petersen . | |
| 2,689,368 | 9/1954 | Finnell | 15/50 R X |
| 2,874,396 | 2/1959 | Smith . | |
| 3,046,586 | 7/1962 | Allen et al. | 15/50 R |
| 3,068,503 | 12/1962 | Jepson et al. . | |
| 3,107,378 | 10/1963 | Jepson et al. . | |
| 3,188,669 | 6/1965 | Beardslee . | |
| 3,303,524 | 2/1967 | Schneider . | |
| 3,397,419 | 8/1968 | Okun . | |
| 3,452,380 | 7/1969 | Walther . | |
| 3,644,960 | 2/1972 | Danzig | 15/50 R X |
| 4,186,459 | 2/1980 | Wulff . | |

*Primary Examiner*—Edward L. Roberts

*Attorney, Agent, or Firm*—Thomas M. McKinley; Jon Carl Gealow; Hugh M. Gilroy

[57] ABSTRACT

A vertical axis floor treating machine and support attachment are disclosed. The machine includes a housing to which the attachment is clamped. The attachment includes a frame having a slide thereon. The frame and slide define an aperture for receipt of the housing. Clamps secure the attachment to the housing.

14 Claims, 4 Drawing Figures

FLOOR POLISHER SUPPORT

BACKGROUND OF THE INVENTION

This invention relates to floor treating machines and more particularly to vertical axis machines for working a cleaning agent into a carpeted floor surface.

Heretofore, various processes have been employed for cleaning carpeted floor surfaces. These processes have used liquid cleaning solutions and dry cleaning compositions. The dry compositions, while typically containing large amounts of liquid such as water and organic solvents, are basically in a powder form. Dry powder cleaning methods possess certain inherent advantages over the wet cleaning methods. The wet methods have certain drawbacks since the solution may damage the carpet fibers or cause shrinkage of the carpet material if improperly applied. The apparatus used with wet processes has generally been bulky and cumbersome. Such apparatus, for example, may include a vacuum source, a solution supply tank, a solution collection tank and a hand-held wand. The hand-held wand may include agitator brushes, one or more spraying nozzles and a suction nozzle to remove the soiled solution from the carpet surface.

With dry powder cleaning processes, the moist coherent cleaning composition is applied over the carpet surface and agitated or worked into the surface. After the powder is brought into contact with the carpet fiber, the powder and removed dirt is lifted from the floor surface by application of a vacuum. As stated above, cleaning powders typically contain a liquid such as water, organic solution or other solvent. The liquid content of the powders can affect their spreadability since the powders tend to agglomerate or pack together. Examples of such coherent cleaning powders may be found in U.S. Pat. No. 3,418,243 to Hoxie, entitled ART OF CLEANING CARPETS and issued on Dec. 24, 1968, and U.S. Pat. No. 4,013,594 to Froehlich, entitled POWDERED CLEANING COMPOSITION OF UREA-FORMALDEHYDE and issued on Mar. 22, 1977.

Various types of equipment have been developed for distributing and working cleaning powders into a carpeted surface. Examples of such specially developed machines may be found in commonly owned U.S. patent application Ser. No. 921,194, filed July 3, 1978, in the name of Bessinger and entitled CARPET CLEANING MACHINE; U.S. Pat. No. 4,019,662 to Dana, entitled FEEDER FOR COHERENT PARTICULATE MATERIAL and issued on Apr. 26, 1977; and U.S. Pat. No. 4,137,590 to Brown, entitled DEVICE FOR SCRUBBING CARPET and issued on Feb. 6, 1979.

As an alternative, the dry powder compositions may be spread on a carpet surface and then worked into the surface with a vertical axis floor treating machine of the floor polisher type. Once the composition is worked into the surface, a conventional vacuum cleaner can be used to remove the cleaning composition from the carpet. When cleaning floor surfaces in this manner, an applicator such as disclosed in U.S. Pat. No. 3,289,240 to VanderVeer et al, entitled DRY RUB SHAMPOO APPLICATOR and issued on Dec. 6, 1966, may be used. The applicator disclosed in this patent basically includes a housing defining a hopper and a pair of rollers having resilient coverings. The rollers dispense the dry powder onto the carpet surface when the applicator is pushed over the surface.

Vertical axis machines having a brush attached thereto may then be used to work the powder into the carpet. It has been found that the entire weight of the machine cannot be supported on the brushes for proper operation. If the entire weight is supported on the brushes, damage to the carpet surface can result. Also, excessive loads could be placed on the motor of the polisher and control problems could be experienced. As a result, it has been proposed to support the weight of the vertical axis machine on wheels or casters or to use a separate attachment support or cradle. The attachment, when secured to the floor polisher, supports most of the weight of the machine. The attachment also controls brush aggressiveness. A drawback of using vertical axis machine and prior supports relates to a lack of confinement of the powder. The rotating brush can "throw" the powder over the carpet. Examples of such attachments or vertical axis floor machine supports may be found in U.S. Pat. No. 2,640,211 to Petersen, entitled RUG SCRUBBING MACHINE and issued on June 2, 1953; U.S. Pat. No. 3,452,380 to Walther, entitled CASTER ASSEMBLY FOR A CONVERTIBLE FLOOR CLEANING MACHINE and issued on July 1, 1969; U.S. Pat. No. 3,397,419 to Okun, entitled TOOL FOR FLOOR TREATING MACHINE and issued on Aug. 20, 1968; and U.S. Pat. No. 4,186,459 to Wulff, entitled CARPET BRUSH ATTACHMENT FOR A FLOOR TREATING MACHINE and issued on Feb. 5, 1980.

A need exists for a vertical axis machine and support attachment which is durable in use, readily attachable and detachable, confines the powder to a given area and which is relatively easy to manufacture.

SUMMARY OF THE INVENTION

In accordance with the present invention, a unique support attachment for a vertical axis, rotary floor machine is provided. Essentially, the support attachment includes a rigid, generally planar frame having a centrally located aperture dimensioned to receive the floor treating element. A shoe or slide member is secured to the under surface of the frame. A plurality of attachment or clamp means are mounted on the frame for readily attaching and detaching the frame to the floor machine.

In use, a vertical axis floor treating element having a plurality of brush segments secured thereto in a generally rectangular array is attached to a conventional floor polisher or vertical axis machine. The machine is disposed within the central aperture of the support attachment and the attachment is clamped to the machine. Substantially the entire weight of the machine is then supported by the attachment and the machine may be pushed over the floor surface. The attachment functions to contain the dry powder within the periphery of the vertical axis machine. The brush element works the powder into intimate contact with the carpet fibers. After the working operation, the powder may be removed from the carpet with a conventional vacuum cleaner.

DETAILED DESCRIPTION OF THE PREFERRED EMBODIMENT

Figure 1:
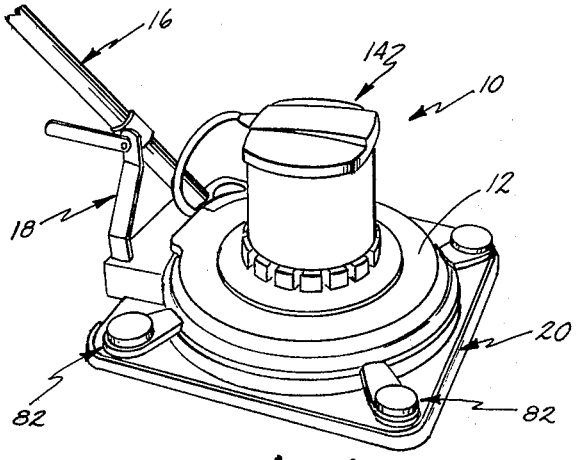
FIG. 1 is a right side, perspective view of a vertical axis machine and support in accordance with the present invention.
Figure 2:
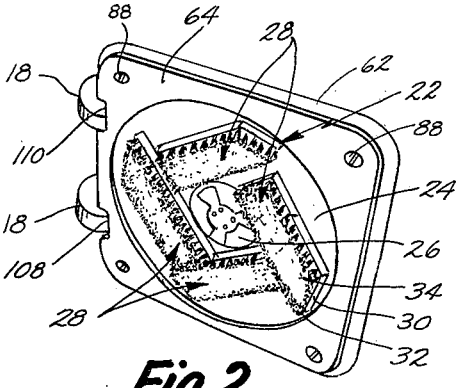
FIG. 2 is a bottom, perspective view thereof.

With reference to the drawings, FIG. 1 illustrates a vertical axis floor treating machine generally designated 10. Machine 10 includes a housing 12 having a drive motor 14 secured thereto. An operator control handle 16 is pivotally mounted to the housing 12. A pair of transport wheels 18 are secured to the rear of the housing. Clamped to the periphery of housing 12 is a support attachment or carriage assembly generally designated 20. Motor 14 rotates a vertical axis floor treating element generally designated 22. Element 22, as seen in FIG. 2, includes a generally circular brush support plate 24 which is secured to the output shaft of motor 14 by a locking adapter 26. A plurality of brush segments 28 are secured to support plate 24. In the preferred embodiment, brush segments 28 each include a base plate 30 fastened to plate 24 and a plurality of rows of bristles 32. Each brush segment is generally rectangular with an angled edge 34. In the preferred construction, four segments are secured to plate 24 in a generally rectangular, overlapping array. This is clearly shown in FIG. 2. The brush element scrubs or works a dry powder cleaning composition into a carpeted floor surface.

Figure 3:
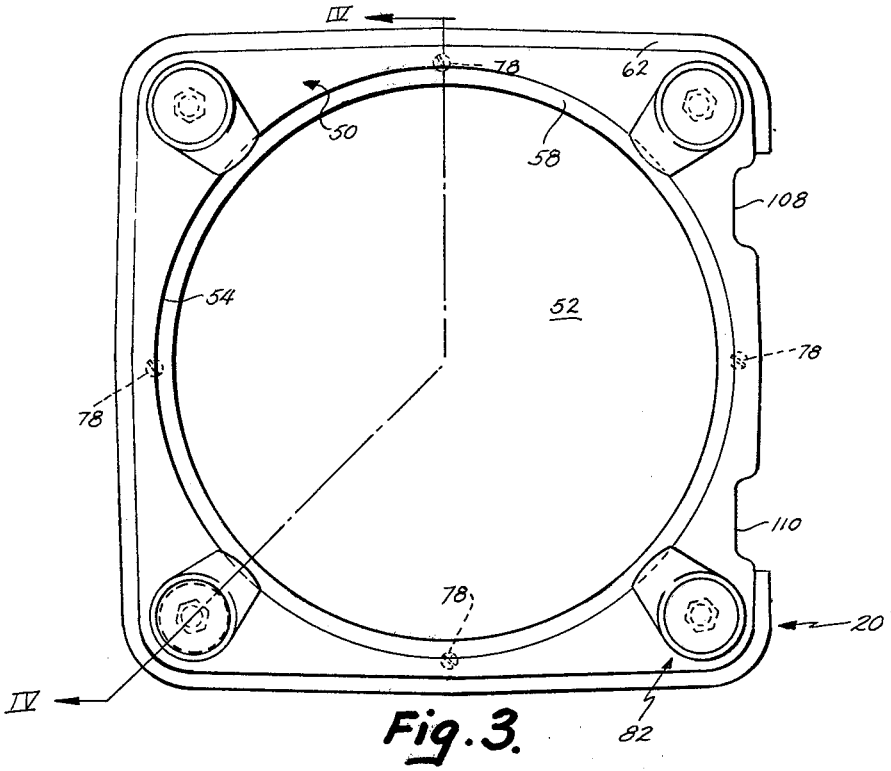
FIG. 3 is a top, plan view of the support attachment.
Figure 4:
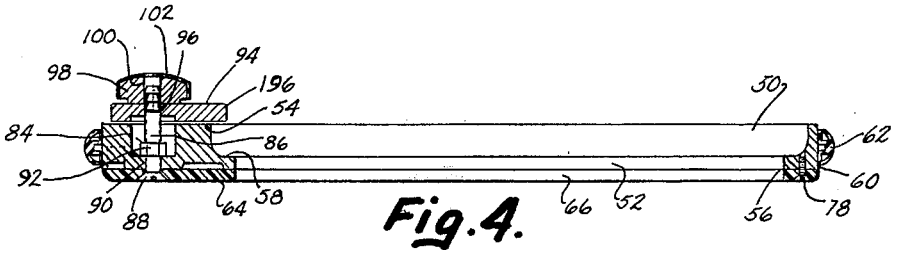
FIG. 4 is a cross-sectional view taken generally along line IV—IV of FIG. 3.

As stated previously, the weight of floor polisher or vertical axis machine 10 cannot be supported entirely on the brush. To do so could overload the motor, cause damage to the carpet fibers and present control problems to the operator. Support or slide carriage 20 in accordance with the present invention supports the weight of the machine on the floor and thereby controls the aggressiveness of the brush elements on the carpet. As best seen in FIGS. 3 and 4, support 20 includes a main frame 50. Frame 50 is preferably a cast, rigid, generally rectangular and planar member which defines a central, circular aperture 52. Frame 50 has a top surface 54 and a bottom surface 56. Top surface 54 defines an annular shoulder 58 around the periphery of central aperture 52 (FIG. 4). Secured to the periphery or outer wall 60 of frame 50 is a resilient bumper strip 62. As best seen in FIGS. 2 and 4, a shoe or slide member 64 is secured to the under surface 56 of main frame 50. Shoe 64 has a similar planar configuration to frame 50 and also defines a central aperture 65. Slide 64 is fastened to under surface 56 of frame 50 by a plurality of screw fasteners 78 equally spaced around the periphery of aperture 66. Apertures 52, 66 of support attachment 20 are dimensioned to receive the circular-shaped housing 12 of the vertical axis machine. The thickness or vertical height dimension of the support is such that vertical floor treating element 22 is supported above the floor surface with bristles 32 in controlled working contact with the carpet.

As seen in FIG. 1, attachment 20 is clamped to housing 12 of the vertical axis machine by a plurality of attachment or clamp means generally designated 82. As best seen in FIGS. 3 and 4, clamp means 82 are spaced equally around the periphery of central aperture 52 in diagonal relationship at the corners of main frame 50. Main frame 50 at each corner defines a recess 84. Extending vertically through each recess is a bolt 86. A head 88 of the bolt engages the slide 64 and passes upwardly through an aperture 90 in frame 50. Bolt 86 is held in position by a nut 92. A clamp member 94 has an aperture 96 through which bolt 86 extends. Clamp member 94 is an elongated member having a forward end 196 which extends over shoulder 58 of aperture 52 (FIG. 4). A lock knob or member 98 has a central aperture 100 which is internally threaded. Member 98 is threaded onto bolt 86 and covered by a suitable decorative, vinyl cover 102. Member 98 clamps or sandwiches member 94 to upper surface 54 of frame 50.

As seen in FIG. 3, the rear of frame 50 and slide 64 include transversely spaced recesses 108, 110. As seen in FIG. 2, recesses 108, 110 accommodate the transport wheels 18 carried by the vertical axis machine housing 12.

In the preferred construction, main frame 50 is fabricated from an aluminum alloy by a conventional sand casting process. The casting is then sand blasted, and the surface is finished. The frame is, therefore, a rigid member. The shoe or slide member 64 of the carriage assembly or support is preferably fabricated from a lubricious plastic material such as polyvinyl chloride. One suitable polyvinyl chloride has a specific gravity in the range of 1.28 to 1.58, to tensile strength of 5000 to 8000 psi and an elongation of 100 to 140 percent. The shoe 64 has a thickness of approximately 0.25 inches and central aperture 66 has a diameter of approximately 12 inches. The main frame has an overall vertical height of approximately 0.94 inches and a thickness at shoulder 58 of approximately 0.25 inches. Central aperture 52 of frame 50 also has a 12 inch diameter. The diameter of the inner peripheral sidewall or the total diameter of shoulder 58 is approximately 12.50 inches.

Each brush segment is preferably fabricated with a high density polyethylene base plate 30. The bristles are arranged in rows on the base plate 30. The bristles are preferably 0.012 diameter nylon bristles with tipped ends. The bristles are positioned in tufts with 160 bristles per tuft and 69 tufts per brush segment.

In use, knobs 98 of each of clamp means 82 would be released so that clamp members 94 may be pivoted or rotated to the side of aperture 52. Housing 12 is then placed on the frame with the brush element within the confines of the aperture (FIG. 2). Clamp members 94 are then moved into engagement with the periphery of housing 12, as seen in FIG. 1, and knobs 98 are tightened to clamp the attachment to the machine. The vertical axis machine may then be operated in a conventional fashion moving over the dry powder dispensed on the carpet. Due to the dimensioning of the attachment 20 and the fact that it surrounds the brush element, the powder agitated and worked into the carpet surface by the brush is maintained essentially within the confines of the attachment 20. The weight of the machine is supported on the floor by the attachment 20. The plastic slide or shoe 64 insures that the machine may be easily moved over the carpeted surface. The brush segment 28 with their rectangular configuration and rectangular positioning efficiently and effectively scrub and work the dry powder into the carpet fibers. After the powder has been worked into the carpet surface, the powder and dirt is easily removed with a conventional vacuum cleaner.

It should now be readily apparent to those of ordinary skill in the art that the support attachment or carriage assembly 20 in accordance with the present invention, in combination with a vertical axis machine, provides an effective means for working a dry powder cleaning composition into intimate contact with carpet fibers. The attachment 20 permits the machine to be easily moved over the surface of the carpet without interfering with or snagging of the carpet fibers. The aggressiveness of the brush element is controlled to insure optimum scrubbing action. The attachment 20 is easily and readily manufactured employing conventional techniques. The clamp means 82 and their positioning around the frame 50 insures that the attachment may be readily and quickly secured to and removed from the conventional floor polishing machine. The frame structure, since it extends around the periphery of the vertical axis floor treating element, serves to confine or contain the powder within the outer periphery of the machine attachment combination.

In view of the foregoing description, various modifications to the present invention might become apparent which would not depart from the inventive concepts disclosed herein. It is therefore expressly intended that the above description should be considered as that of the preferred embodiment. The true spirit and scope of the present invention may be determined by reference to the appended claims.

The embodiments of the invention in which an exclusive property or privilege is claimed are defined as follows:

1. A support attachment for a vertical axis, rotary floor machine of the type having a housing, a vertical axis floor treating element rotatably supported by said housing and a drive for rotating the element, said support attachment comprising:

a rigid generally planar frame having a centrally located aperture dimensioned to receive the floor treating element;

a shoe having the same general configuration as said frame;

means for attaching said shoe to said frame; and a plurality of attachment means on said frame positioned around said aperture for releasably attaching said frame to the housing of the floor machine, said frame and said shoe dimensioned so that the weight of the machine will be supported on the attachment and the floor treating element will be confined within the frame and shoe.

2. A support attachment as defined by claim 1 wherein each of said attachment means comprises:

a generally planar clamp; and holding means for securing said clamp in a fixed position on said frame so as to clamp the machine housing to the frame.

3. A support attachment as defined by claim 2 wherein said holding means comprises:

a fastener secured to said frame and extending through said frame and an aperture defined by said clamp; and a knob threaded to the free end of said fastener above said clamp.

4. A support attachment as defined by claim 3 wherein said shoe is formed from a smooth, rigid, plastic material to reduce the friction between the attachment and a carpeted floor surface.

5. A vertical axis floor treating machine adapted for working a dry powder cleaning composition into a carpeted floor, said machine comprising:

a generally planar support frame having an upper surface, a lower surface and a generally centrally positioned aperture;

a slide on the under surface of said support frame, said slide having the same general configuration as said support frame and also having a generally centrally positioned aperture;

a housing;

clamp means on said frame for releasably clamping said frame to said housing;

a vertical axis floor treating element dimensioned to be positioned within said aperture, said element having a plurality of brushes thereon; and drive means on said housing for rotating said element about a vertical axis.

6. A vertical axis floor treating machine as defined by claim 5 wherein said clamp means comprises:

a generally planar member; and holding means for securing said member in a fixed position on said frame so that said member clamps the housing to the frame.

7. A vertical axis floor treating machine as defined by claim 6 wherein said holding means comprises:

a fastener secured to said frame and extending through said frame and an aperture defined by said member; and a knob threaded to the free end of said fastener above said planar member.

8. A vertical axis floor treating machine as defined by claim 7 wherein said slide member is formed from a smooth, rigid, plastic material to permit the machine to move easily over the carpeted floor.

9. A vertical axis floor treating machine as defined by claim 8 wherein said rigid, plastic material is polyvinyl chloride.

10. A vertical axis floor treating machine as defined by claim 8 wherein said vertical axis floor treating element comprises:

a brush mounting plate; and a plurality of said brush segments secured to said plate deposed in a generally rectangular open pattern about a central rotary axis of said plate, said segments forming an edge of the rectangular pattern extending beyond an adjacent orthogonal edge of the rectangular pattern to the perimeter region of said plate.

11. A vertical axis floor treating machine as defined by claim 7 wherein said vertical axis floor treating element comprises:

a brush mounting plate; and a plurality of said brush segments secured to said plate deposed in a generally rectangular open pattern about a central rotary axis of said plate, said segments forming an edge of the rectangular pattern extending beyond an adjacent orthogonal edge of the rectangular pattern to the perimeter region of said plate.

12. A vertical axis floor treating machine as defined by claim 5 wherein said vertical axis floor treating element comprises:

a brush mounting plate; and a plurality of brush segments secured to said plate deposed in a generally rectangular open pattern about a central rotary axis of said plate, said segments forming an edge of the rectangular pattern extending beyond an adjacent orthogonal edge of the rectangular pattern to the perimeter region of said plate.

13. A vertical axis machine adapted for working a dry powder cleaning composition into a carpeted floor, said machine comprising:

a generally planar support frame having an upper surface, a lower surface, and a generally centrally positioned circular aperture;

a slide on the under surface of said support frame, said slide having the same general configuration as said support frame and also having a generally centrally positioned aperture, said slide being formed from a smooth rigid polyvinyl chloride plastic to permit the machine to move easily over the carpeted floor;

a housing;

a clamp means including a generally planar member and means for holding said member in a fixed position on said frame for releasably clamping said frame to said housing, said means for holding said member including a fastener extending through said frame and an aperture defined by said member, and a knob threaded on said fastener with the member between said knob and said frame;

a vertical axis floor treating element dimensioned to be positioned within said apertures of said frame and slide, said element having a plurality of brushes thereon; and drive means on said housing for rotating said element about a vertical axis.

14. A vertical axis floor treating machine as defined by claim 13 wherein said vertical axis floor treating element comprises:

a brush mounting plate; and a plurality of said brush segments secured to said plate in a generally rectangular pattern about a central rotary axis of said plate.

* * * * *